US005632491A

United States Patent [19]

Hamas

[11] Patent Number: 5,632,491

[45] Date of Patent: May 27, 1997

[54] TARGET ATTACHING APPARATUS

[76] Inventor: Marc R. Hamas, 51792 TR 178, Fresno, Ohio 43824

[21] Appl. No.: 620,415

[22] Filed: Mar. 22, 1996

[51] Int. Cl.[6] ..... F41J 1/10

[52] U.S. Cl. ..... 273/407; 24/501; 40/645; 40/666

[58] Field of Search ..... 273/403, 404, 273/406, 407; 24/489, 499, 500, 501; 40/1.5, 652, 666, 667, 645

[56] References Cited

U.S. PATENT DOCUMENTS

| | | | |
|---|---|---|---|
| 497,594 | 5/1893 | McGrady | 40/666 X |
| 4,029,318 | 6/1977 | Boss | 273/407 |
| 4,261,121 | 4/1981 | Coon | 40/666 X |
| 4,761,862 | 8/1988 | Himorori | 40/658 X |

*Primary Examiner*—William H. Grieb
*Attorney, Agent, or Firm*—Renner, Kenner, Greive, Bobak, Taylor & Weber

[57] ABSTRACT

A target attaching apparatus, which provides for the attachment of a target to any available structure, includes a spring-biased clamp connected to a mounting member. The clamp includes an attachment end opposite a handle end, wherein the attachment end is mounted onto a structure, such as a tree branch, and wherein the handle end is employed to open and close the attachment end. The mounting member, which is secured to the clamp, includes a cross-piece having opposed ends with a target secured to each end. In one embodiment, the mounting member is secured to the clamp by an adhesive and the target is secured to the cross-piece also by an adhesive. The user manipulates the spring-biased clamp to open the attachment end for securing the same to an available structure. This provides a variety of angles at which the target can be shot at. The apparatus is primarily of a wooden construction to withstand the impact of multiple bullets or projectiles which are directed toward the target.

14 Claims, 2 Drawing Sheets

TARGET ATTACHING APPARATUS

TECHNICAL FIELD

The invention herein resides generally in the art of stationary shooting targets. More particularly, the present invention relates to a target that is attachable to any available structure or outcropping. Specifically, the present invention relates to a target attaching apparatus which includes a target at which projectiles are aimed and wherein the target is secured to a spring-biased clamp.

BACKGROUND ART

In the sports of shooting and hunting, a sportsman practices shooting rifles, pistols, air guns and the like at indoor and outdoor shooting ranges. This practice includes shooting projectiles at appropriately shaped targets from various positions such as prone, kneeling and standing to name a few. These targets, which are typically made of paper or other fibrous material, are either shaped in the form of various animals or have concentric rings with point values associated with each ring. It is also known to employ targets to adjust the gun sight to account for various peculiarities in the sportsman's aim.

When sportsmen desire to practice their shooting technique outdoors, they arrange various shapes and sizes of targets in desired positions. Typically, targets are nailed or stapled to upright or fallen trees, or mounted to frames from which the target is suspended. These frames can either be free standing or staked into the ground.

These known target holding devices have several inherent limitations. Primarily, the aforementioned targets are limited to where and how they are placed. For example, the sportsman must carry extra tools to affix the target to the ground or a tree. Target holding frames tend to be bulky and awkward to carry. Moreover, the target holding frames and stakes only provide a limited number of shooting angles at which a sportsman can use. Moreover, these frames and stakes are likely to be damaged by stray bullets or projectiles which do not hit the target. There is also the risk of bullet ricochets from metal frames or metal stakes used to carry the targets.

Based upon the foregoing, it is evident that there is a need in the art for a target attaching apparatus which is easily affixable in a variety of positions to provide a maximum number of shooting angles. Moreover, there is a need for a relatively inexpensive target attaching apparatus that diminishes the concern of damage thereto. There is also a need for a target attaching apparatus which is sturdy enough to withstand the impact of numerous projectiles that strike the apparatus. There is also a need for a target attaching apparatus which is adaptable for use with various shapes and sizes of targets.

DISCLOSURE OF INVENTION

In light of the foregoing, it is a first aspect of the present invention to provide a target attaching apparatus that effectively carries a target.

Another aspect of the present invention is to provide a target attaching apparatus that includes a spring-biased clamp which has an attachment end opposite a handle end, wherein the attachment end is mountable to any available structure, projection, outcropping or the like.

Still a further aspect of the present invention is to provide a target attaching apparatus, as set forth above, wherein a mounting member is attached to the clamp.

Yet an additional aspect of the present invention is to provide a target attaching apparatus, as set forth above, wherein the mounting member includes a cross-piece with the target or targets attached thereto.

Still another aspect of the present invention is to provide a target attaching apparatus, as set forth above, wherein the mounting member is adhesively secured to the clamp member and wherein the target is adhesively secured to the cross-piece.

An additional aspect of the present invention is to provide a target attaching apparatus, as set forth above, wherein the attachment end has attachment notches to fit on any available structure.

The foregoing and other aspect of the invention which shall become apparent as the detailed description proceeds, are achieved by a target attaching apparatus, comprising: a clamp having an attachment end and a handle end, the attachment end attachable to any available structure; and at least one target secured to the handle end.

The present invention also provides a target holding apparatus, comprising: a spring-biased clamp attachable to an available structure; a target; and means for mounting the target to the spring-biased clamp.

The present invention also provides a target attaching apparatus, comprising: a pair of opposed fingers, each finger having a handle end opposite an attachment end; a spring pivotably interconnecting the pair of opposed fingers, wherein each attachment end is biased toward the other by the spring; a cross-piece secured to one of the pair of opposed fingers; and a pair of targets secured to the cross-piece.

BRIEF DESCRIPTION OF THE DRAWINGS

For a complete understanding of the objects, techniques and structures of the invention, reference should be made to the following detailed description and accompanying drawings wherein.

BEST MODE FOR CARRYING OUT THE INVENTION

Figure 1:
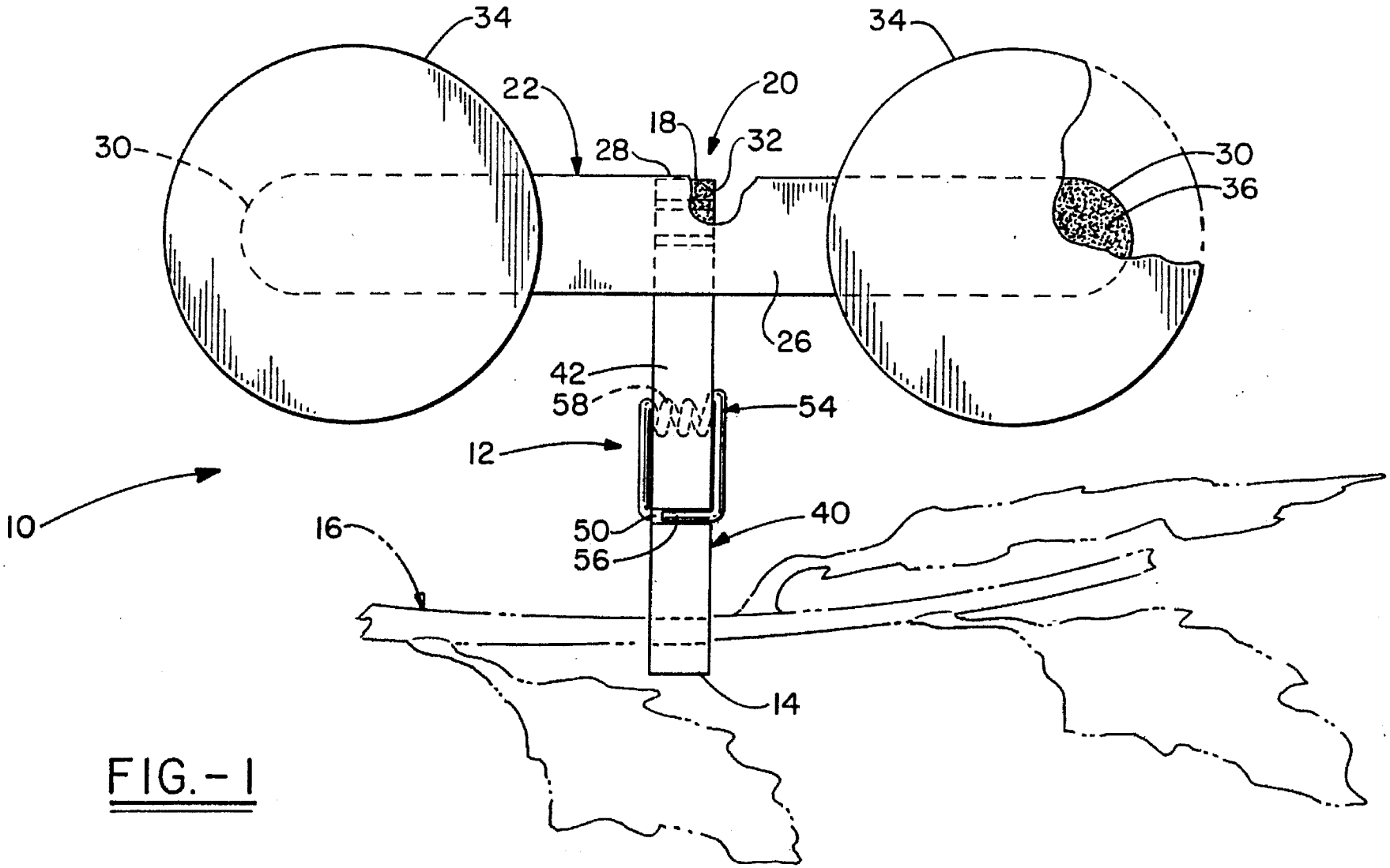
FIG. 1 is a front elevational view, in partial cross-section, of the target attaching apparatus according to the present invention.
Figure 2:
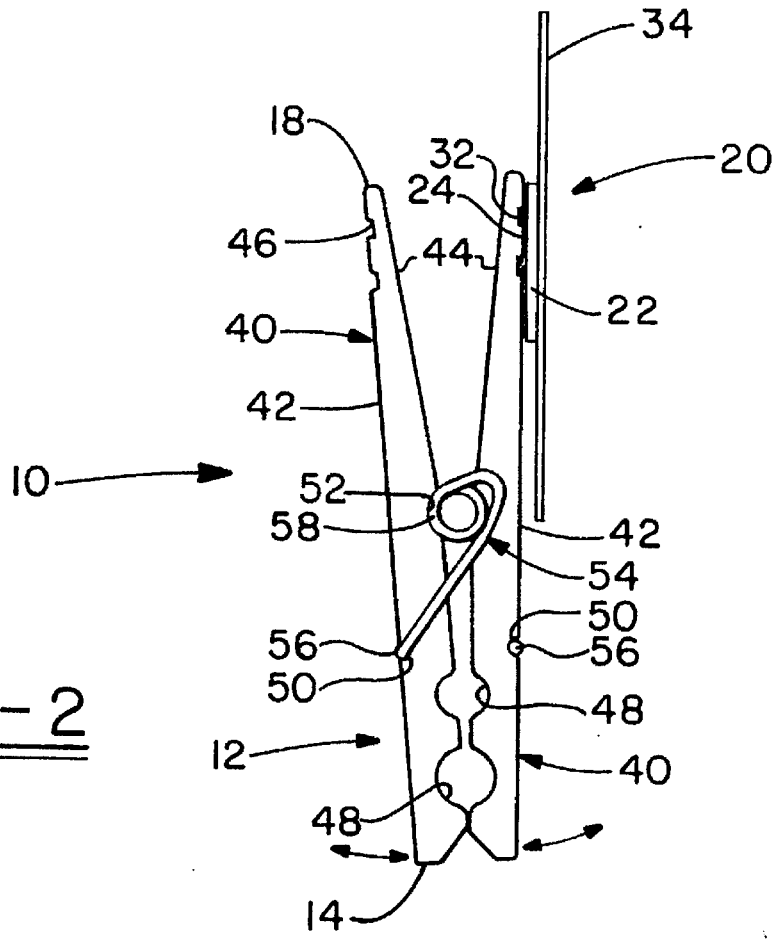
FIG. 2 is a side view of the target attaching apparatus.

Referring now to all the drawings and in particular to FIGS. 1 and 2, it can be seen that a target attaching apparatus according to the present invention is designated generally by the numeral 10. The apparatus 10 includes a spring-biased clamp 12 that has an attachment end 14 that is mountable on any available structure such as a tree branch 16. In the preferred embodiment, the clamp 12 is a commercially available wooden clothespin. Although the clamp 12 can be attached to the tree branch 16, it will be appreciated that the damp could be attached to scrap wood, previously erected signs, rocks, vines, roots or any other projection or outcropping which is found in an isolated area safe for shooting a firearm or other weapon. Opposite the attachment end 14 is a handle end 18, which when depressed opens the clamp 12 for securing to any available structure.

A mounting member 20 is secured by the appropriate means to the handle end 18. The mounting member 20 is attached to the clamp 12 and rigidly extends therefrom. In other words, the mounting member 20 is made of a rigid material that does not fall upon itself when the target attaching apparatus is located or positioned in various configurations. The mounting member 20 includes a cross-piece 22 which is substantially perpendicular to the handle end 18. It will be appreciated, however, that the cross-piece 22 can be positioned at any desired angle with respect to the clamp 12. In the preferred embodiment, the cross-piece 22 is a wooden tongue depressor having a length of about 6 inches and a width of about 0.75 inch. The cross-piece 22 has an attachment surface 24 opposed by a facing surface 26. The cross-piece 22 also has a mid-point 28 and opposed ends 30 which interconnect the attachment surface 24 to the facing surface 26. Although only two ends 30 are presented in this embodiment, it will be appreciated that a plurality of three, four or more ends could be provided by the cross-piece 22. The cross-piece 22 is secured to the handle end 18 by an adhesive 32 such as a commercially available wood glue.

A target 34, which is typically circular and of a fluorescent color, is secured to the facing surface 26 at each of the opposed ends 30. By placing the targets 34 at the opposed ends 30, the risk of bullets damaging the clamping member 12 is greatly reduced to ensure maximum use of the apparatus 10. An adhesive 36, such as a commercially available wood glue, is employed to secure the target 34 to the cross-piece 22. The target 34 may be made of construction paper having a thickness ranging from about 0.002 inch to about 0.250 inch. Of course, any other fibrous or polymeric material may be employed for use as the target 34. Moreover, the targets 34 may be provided in any shape, size or color as desired by the sportsman using the target attaching apparatus 10. Of course, any desired indicia may be disposed on the target 34. Alternatively, the targets 34 may be made of clay. Although clay targets disintegrate when hit by a projectile and accordingly can only be used once, clay targets provide a clear indication that the target has been struck by a projectile.

The clamp 12 includes a pair of opposed fingers 40, wherein each finger has an exterior surface 42 and a facing interior surface 44. Each finger 40 may have a plurality of grip notches 46 on the exterior surface 42 at the attachment end 14. The cross-piece 22 is secured to one of the exterior surfaces 42 in the area where the grip notches 46 are disposed. Disposed on the interior surface 44 are a plurality of attachment notches 48 which are employed to grip the tree branch 16 or other available structure. The exterior surface 42 also has a connection notch 50 disposed between the grip notches 46 and the attachment notches 48. Additionally, the interior surface 44 has a coil notch 52 disposed between the handle end 18 and the attachment end 14.

A spring 54 has opposed ends 56 each of which is received in the appropriate connection notch 50. A coil 58, which is between the opposed ends 56, is received in the coil notches 52 and functions as a pivot point for when pressure is applied to the handle end 18 of the clamp 12. Those skilled in the art will appreciate that other types of springs such as a leaf spring may be employed by the spring-biased clamp 12.

In use, the sportsman selects an isolated area in which shooting can be practiced. Upon selecting a location for affixing the apparatus 10, the sportsman depresses the handle end 18 to pivotably move the opposed fingers 40 toward one another. This opens the attachment end 14 for mounting to the desired structure. Upon release of handle end 18, the attachment end 14 returns to its normal position with the structure received therebetween. Afterward, the sportsman steps off the desired distance from the target 34 and begins shooting. If the position of the target 34 is unsatisfactory, the sportsman can easily re-adjust the position of the clamp 12 as needed.

It has been found that by employing a wooden clamp 12, a wooden cross-piece 22 and targets 34 made of a fibrous material, such as paper, that the target attaching apparatus 10 is long lasting and can withstand the impact of multiple bullets or other projectiles. It has been determined that wood is of sufficient rigidity to hold the apparatus 10 to the desired structure while being capable of absorbing the impact of a bullet. In other words, other materials have been found to splinter or disintegrate upon impact of a bullet whereas the materials mentioned above, although damaged by a bullet, do not disintegrate or splinter. This maximizes the use of the targets 34. It will be appreciated that additional cross-pieces can be secured to the clamp 12, after the original shot-up cross-piece is removed.

As is apparent from the structure and use disclosed herein, the target attaching apparatus presents numerous advantages. Primarily, the apparatus 10 allows the user to obtain various shooting angles which are only limited by the availability of a structure to which the apparatus 10 can be mounted. The structure of the apparatus 10 is such that it can withstand many impacts from projectiles, such as bullets, without disintegrating or splintering which would otherwise require the reattachment of the target or other target holding device. Still another advantage of the present invention is that it is made from relatively inexpensive materials and is easily manufactured.

Still another advantage of the present invention is that it is adaptable to various shapes and sizes of the clamping member and the targets. Still another advantage of the present invention is that the apparatus 10 is able to absorb the impact of projectiles while precluding the deflection thereof which may otherwise cause injury to the user.

Figure 3:
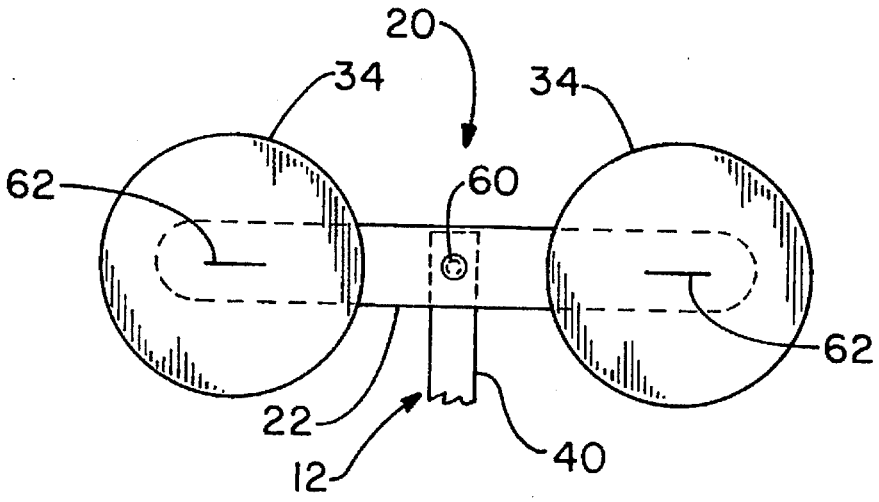
FIG. 3 is a partial front elevational view showing alternative methods for securing components of the target attaching apparatus.

An alternative embodiment of the target attaching apparatus 10 is provided in FIG. 3 wherein other means are employed to secure the components of the target attaching apparatus 10. In particular, a mechanical type fastener 60 may be employed to secure the cross-piece 22 to the handle end 18 of the clamp 12. The fastener 60, could include but is not limited to wood screws, rivets, heavy duty staples and the like. A staple 62 may be employed to secure the target 34 to the opposed ends 30 of the cross-piece 22. It will be appreciated that other similar mechanical fastening means may also be employed to secure the target 34 to the cross-piece 22. It will be further appreciated that the cross-piece 22 could be formed from a singular piece of material, wherein the target 34 is an extension of the cross-piece 22. Similarly, one of the fingers 40, the cross-piece 22 and the targets 34 may be of a single piece construction.

Thus it can be seen that the objects of the invention have been attained by the structure present above. While in accordance with the patent statutes only the best mode and preferred embodiment of the invention has been presented and described in detail, the invention is not limited thereto or thereby. Accordingly, for an appreciation of the true scope and breadth of the invention, reference should be made to the following claims.

What is claimed is:

1. A target attaching apparatus, comprising:

a clamp having an attachment end and a handle end, said attachment end attachable to any available structure;

a mounting member carried by said clamp, said mounting member having a cross-piece with at least one end thereof extending from said clamp; and at least one target secured to said at least one end.

2. The target attaching apparatus according to claim 1, wherein said cross-piece includes a pair of opposed ends with a mid-point therebetween secured to said handle end, each of said opposed ends having a singular one of said targets secured thereto, said cross-piece secured to said handle end in a substantially perpendicular relationship.

3. The target attaching apparatus according to claim 1, wherein said clamp comprises:

a pair of opposed fingers; and a spring pivotably interconnecting each of said opposed fingers to one another, said opposed fingers movable between a clamping position and an open position.

4. The target attaching apparatus according to claim 3, wherein said cross-piece has a plurality of ends, each of said plurality of ends having a singular one of said targets secured thereto.

5. A target attaching apparatus, comprising:

a spring-biased clamp having opposed ends, one end attachable to an available structure;

a target; and means for mounting said target carried by said spring-biased clamp near said opposite end, said mounting means comprising a cross-piece secured to said handle end, said cross-piece having at least one end extending from said handle end, and means for securing said target to said cross-piece at an end away from said handle end.

6. The target attaching apparatus according to claim 5, wherein said spring-biased clamp comprises a pair of fingers interconnected by a spring, each one of said pair of fingers having an attachment end opposite a handle end, said attachment end having at least one attachment notch, said mounting means adhesively secured to said handle end, said attachment notches adaptable to receive the available structure.

7. The target attaching apparatus according to claim 6, wherein said cross-piece has an attachment surface opposite a facing surface and a plurality of ends connecting said attachment surface to said facing surface, each said plurality of ends having at least one of said targets adhesively secured to said facing surface, said attachment surface adhesively secured to said handle end.

8. The target attaching apparatus according to claim 6 wherein said securing means is a staple.

9. A target attaching apparatus, comprising:

a pair of opposed fingers, each said finger having a handle end opposite an attachment end;

a spring pivotably interconnecting said pair of opposed fingers, wherein each said attachment end is biased toward the other by said spring;

a cross-piece secured to one of said pair of opposed fingers; and a pair of targets secured to said cross-piece.

10. The target attaching apparatus according to claim 9 wherein each of said pair of opposed fingers has an exterior surface opposite an interior surface, said interior surfaces facing one another, and wherein said cross-piece is adhesively secured to one of said exterior surfaces.

11. The target attaching apparatus according to claim 10 wherein said cross-piece has a pair of opposed ends and an attachment surface opposite a facing surface, said attachment surface adhesively secured to one of said exterior surfaces and said pair of targets adhesively secured to said facing surface.

12. The target attaching apparatus according to claim 10 wherein said cross-piece is made of wood and wherein each of said opposed ends has one of said pair of targets secured thereto.

13. The target attaching apparatus according to claim 11 wherein said target is a fibrous material having a thickness ranging from about 0.002 inch to about 0.250 inch.

14. The target attaching apparatus according to claim 11 where said target is made of clay.

* * * * *